US006244400B1

(12) United States Patent
Bowers

(10) Patent No.: US 6,244,400 B1
(45) Date of Patent: Jun. 12, 2001

(54) PERSONALIZED, MODULARIZED CARRYING CASE

(76) Inventor: Susan D. Bowers, 619 University Ave., Burbank, CA (US) 91505

( * ) Notice: Subject to any disclaimer, the term of this patent is extended or adjusted under 35 U.S.C. 154(b) by 0 days.

(21) Appl. No.: 09/480,608

(22) Filed: Jan. 10, 2000

(51) Int. Cl.[7] ..... A45C 1/02; A45C 3/02; A45C 5/12; A45C 11/04

(52) U.S. Cl. ..... 190/110; 190/108; 190/901; 150/111

(58) Field of Search ..... 190/110, 102, 190/901, 108; 150/111

(56) References Cited

U.S. PATENT DOCUMENTS

| | | | | |
|---|---|---|---|---|
| 2,069,255 | * | 2/1937 | Lofton | 190/901 X |
| 2,316,328 | * | 4/1943 | Guenther et al. | 190/110 X |
| 2,536,169 | * | 1/1951 | Gray | 190/901 X |
| 2,648,366 | * | 8/1953 | Higbee et al. | 190/110 X |
| 2,755,837 | * | 7/1956 | Kosek | 190/901 X |
| 3,306,405 | * | 2/1967 | Rosenblum | 190/110 |
| 4,257,463 | * | 3/1981 | Monaco | 150/111 |
| 4,263,951 | * | 4/1981 | Siegel | 150/111 |
| 5,018,609 | * | 5/1991 | Brenner | 190/110 X |
| 5,242,056 | * | 9/1993 | Zia et al. | 190/110 X |

* cited by examiner

*Primary Examiner*—Sue A. Weaver
(74) *Attorney, Agent, or Firm*—Morland C. Fischer

(57) ABSTRACT

A carrying case having first and second sides and sheets of hook and loop fastener material (Velcro) extending along each of the first and second sides. A business article (e.g. a writing pad) having a piece of hook and loop fastener material is detachably connected to the sheet of hook and loop fastener material at one side of the carrying case. A man's or woman's purse having pieces of hook and loop fastener material on the exterior sides thereof is detachably connected to the sheet of hook and loop material at the second side of the carrying case. The purse also has hook and loop fastener material extending along the interior sides. A plurality of personal and business modules (e.g. a key case, eye glasses, business card holder, etc.) having pieces of hook and loop fastener material are selectively organized and detachably connected to the hook and hoop fastener material at the interior sides of the purse so as to be readily visible and accessible to the user.

12 Claims, 4 Drawing Sheets

PERSONALIZED, MODULARIZED CARRYING CASE

BACKGROUND OF THE INVENTION

1. Field of the Invention

This invention relates to a carrying case within which one or more business articles and a woman's or man's purse are removably attached by means by complementary pieces of hook and loop fastener material. A set of personal and/or business modules (e.g. keys, eyeglasses, calculator, credit card holder, etc.) that are selected and organized according to the personal needs of the users are removably attached within the purse by means of complementary pieces of hook and loop fastener material.

2. Background Art

Men and women will often have to carry with them a variety of different articles that are needed or used at both home and in business. For example, a business person may tote a hand held carrying case between the home and office or on trips in order to transport such personal articles as a set of keys for the car, home and office, a calculator, reading glasses, credit cards, and the like, along with such business articles as a personal computer, business cards, a writing tablet, etc. However, it is common for the business person to simply toss all of the personal and business articles together within the carrying case.

Consequently, when the carrying case is opened, a particular article is not immediately available, such that the user may not be able to easily find the article for which he is searching. In fact, the user is often unable to quickly or accurately determine the identity of all of the articles being carried without first dumping the entire collection of articles from the carrying case for inspection. In some situations, it may be desirable to leave the carrying case behind and only remove some of the articles to be carried from place-to-place. However, it may not suitable for the user to stuff his pockets with such articles. In other situation, it is often desirable to be able to quickly and easily substitute one or more articles in the carrying case for existing articles depending upon the changing needs of the user.

Accordingly, it would be desirable to have a carrying case to permit a user to transport a number of articles for use at home or in business so that the articles will be organized according to the needs of the user and readily available to be replaced with other articles or removed from and conveniently transported outside the confines of the carrying case.

Examples of portable systems which use hook and loop fastener means for retaining articles are available by referring to the following U.S. Pat. Nos.

4,811,769 Mar. 14, 1989

4,854,432 Aug. 8, 1989

5,680,914 Oct. 28, 1997

SUMMARY OF THE INVENTION

In general terms, a carrying case is disclosed within which a variety of different personal and business modules are to be transported. Such personal and business modules may include, but are not limited to, a writing tablet, a personal computer, a set of keys, a calculator, reading glasses, business cards, credit cards, and the like. The carrying case has a pair of sides that are rotated to the closed configuration in opposing face-to-face alignment. A zipper holds the carrying case in the closed configuration with the opposing sides disposed adjacent one another.

A first sheet of hook and loop fastener material, known commercially as Velcro, is affixed inside a first side of the carrying case. A second sheet of such hook and loop fastener material is affixed inside the opposite side of the carrying case. The business articles to be transported by the user have one or more pieces of complementary hook and loop fastener material affixed thereto so as to be removably connected to one of the sheets of hook and loop fastener material at one side of the carrying case. A purse, such as that which is carried by a man or a woman, also has one or more pieces of complementary hook and loop fastener material so as to be removably connected at the second of the sheets of hook and loop fastener material at the other side of the carrying case.

The purse transported within and removably connected to the carrying case also has sheets of hook and loop fastener material affixed inside the opposite sides thereof. The personal and business modules to be transported by the user have one or more complementary pieces of hook and loop fastener material affixed thereto so as to be removably connected to the sheets of hook and loop fastener material at the opposite sides of the purse. Accordingly, the personal and business modules can be organized and held in place inside the purse according to the particular needs of the user. That is, rather than being deposited as a loose collection at the bottom of a conventional purse, the personal and business modules will be neatly arranged and readily available to the user. Moreover, one or more of the modules can be replaced as the user's needs change by simply detaching a module after breaking the bond between the complementary pieces of hook and loop fastener material and then substituting a different module therefor. In this same regard, the purse which holds the personal and business modules of the user can be removed from the carrying case to enable the user to transport the personal and business modules within the purse while leaving the carrying case behind.

DETAILED DESCRIPTION

Figure 1:
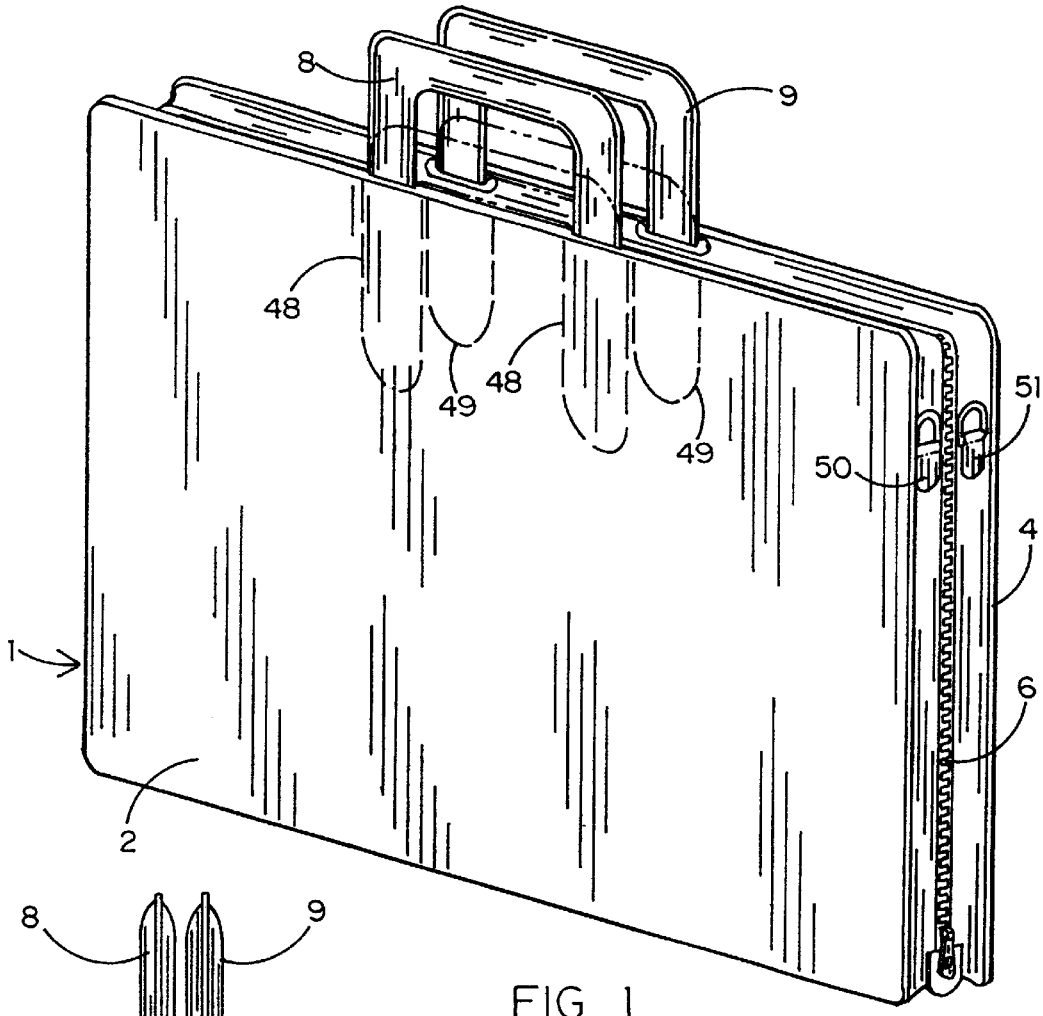
FIG. 1 shows the personalized, modularized carrying case of the present invention in the closed configuration.
Figure 2:
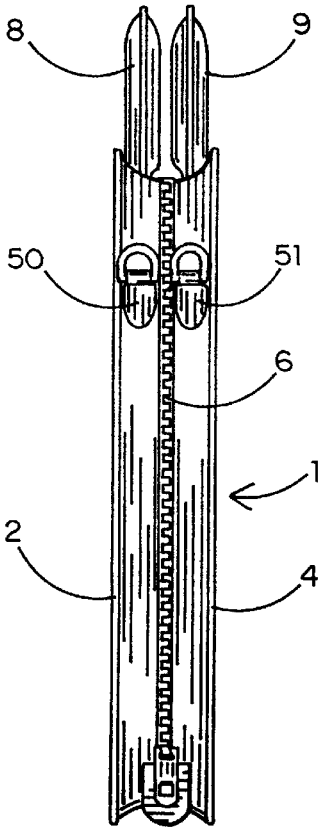
FIG. 2 is a side view of the carrying case of FIG. 1.

The personalized, modularized carrying case which forms the present invention is initially described while referring to FIGS. 1 and 2 of the drawings where a carrying case 1 is shown in the closed configuration. The carrying case 1 illustrated in the drawings is manufactured from a relatively soft leather or similar pliant material. However, it is to be understood that the material from which carrying case 1 is manufactured is not to be regarded as a limitation of the invention, such that carrying case 1 may also be manufactured from a relatively hard material such as plastic, metal or the like.

The carrying case 1 includes a pair of sides 2 and 4 that are held in opposite facing alignment in the closed configuration by means of a conventional fastener, such as a zipper 6. In the event that the carrying case were of the hard shell type, the zipper 6 would typically be replaced by a pair of snap fasteners. Retractable handles 8 and 9 are attached at opposite sides 2 and 4 of the carrying case 1 to facilitate the carrying case being transported from place-to-place by a user. The retractable handles 8 and 9 may be pushed downwardly so as to slide inwardly of respective pairs of channels 48 and 49 extending within the sides 2 and 4 of the carrying case 1. A pair of catches 50 and 51 is secured near the top of each of the sides 2 and 4 by which to attach respective shoulder straps (not shown) to the carrying case 1. At times when it is desirable to transport the carrying case 1 on the shoulder of the user rather than by hand, the retractable handles 8 and 9 are pushed into their channels 48 and 49 (shown in phantom in FIG. 1), and conventional shoulder straps are clipped to catches 50 and 51.

Figure 3:
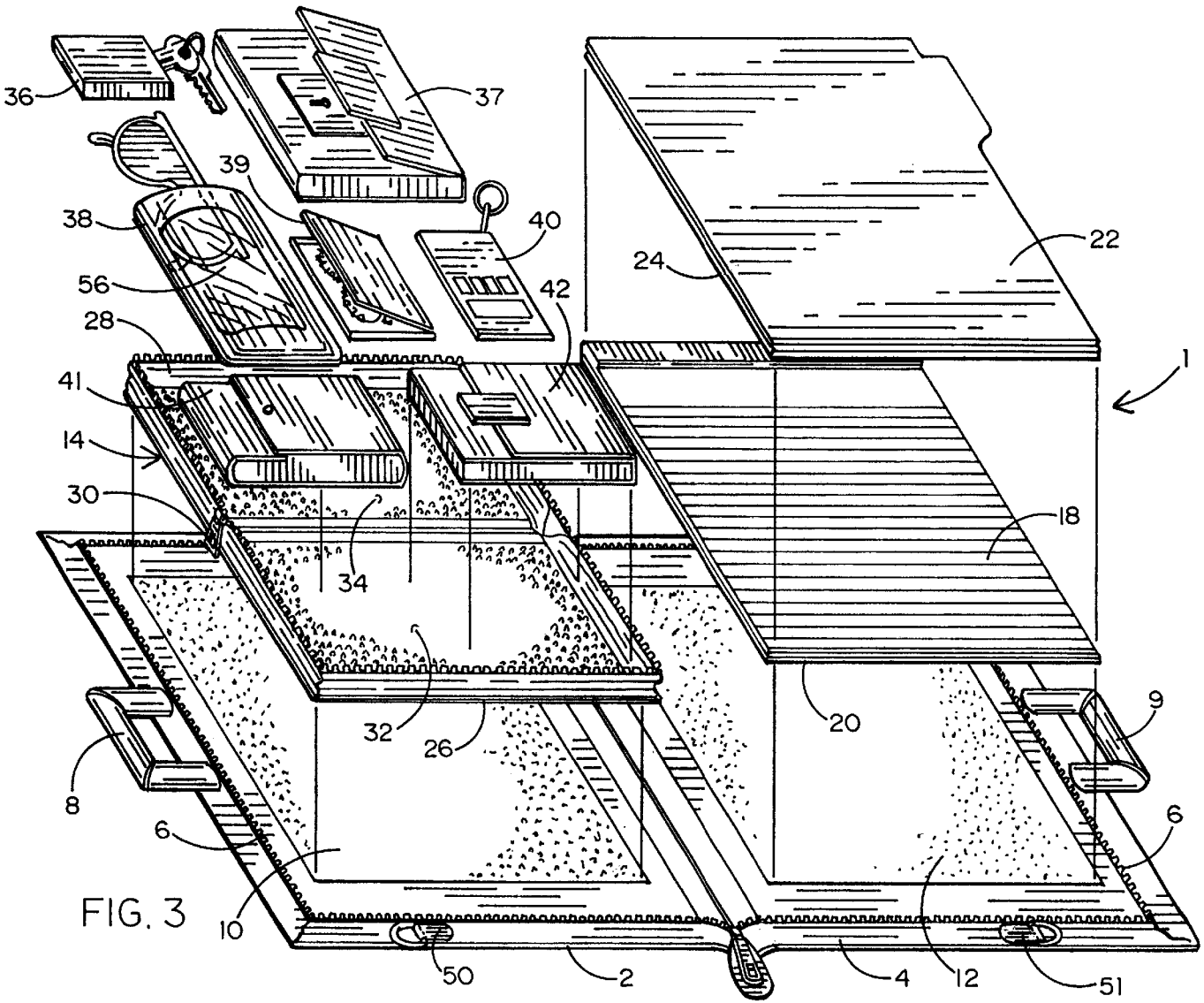
FIG. 3 shows the carrying case in the open configuration with a purse and one or more business modules removably connected to opposite sides of the carrying case.

Turning now to FIG. 3 of the drawings, the carrying case 1 is shown in the open configuration at which to expose the interior thereof for access by the user. In accordance with one important aspect of this invention, a first sheet 10 of hook and loop fastener material is affixed inside one side 2 of the carrying case 1. Such hook and loop fastener material is known commercially as Velcro. In this same regard, a second sheet 12 of hook and loop fastener material is affixed inside the opposite side 4 of the carrying case 1. However, it is within the scope of this invention to affixed geometric patterns (e.g. circle, rectangles, etc.) rather than full sheets 10 and 12 of hook and loop fastener material inside the opposite sides 2 and 4 of the carrying case 1.

By virtue of the sheets 10 and 12 of hook and loop fastener material, different personal and/or business modules may be removably connected along the sides 2 and 4 at the interior of the carrying case 1. Such personal and business modules are those that are commonly used for daily life, work and school. By way of example, a purse 14, such as that often used by both men and women, alike, is detachably connected to the sheet 10 of hook and loop fastener material at one side (e.g. 2) of the carrying case 1. To accomplish the foregoing, one or more pieces (e.g. designated 16 and best shown in FIG. 5) of complementary hook and loop fastener material are affixed (e.g. sewn) to the exterior of the purse 14. The purse 14 and soon to be disclosed personal and business submodules that are attached to and carried within the purse 14 will be described in greater detail hereinafter.

Detachably connected to the sheet 12 of hook and loop fastener material at the opposite side 4 of the carrying case 1 is a conventional note pad 18. Like the purse 14, the note pad 18 has one or more pieces 20 of complementary hook and loop fastener material affixed to the back side thereof By pressing the notepad 18 against the side 4 of carrying case 1, the pieces 20 of hook and loop fastener material affixed to the notepad will be moved into contact with and mated to the sheet 12 of hook and loop fastener material affixed to the carrying case, whereby the notepad 18 will be held in place until a pulling force is exerted on the notepad 18 that is sufficient to break the bond between the hook and loop fastener materials 12 and 20, whereby the notepad 18 can then be removed from the carrying case 1.

With the notepad 18 attached along a side 4 of the carrying case 1, a convenient work surface will be established when the carrying case 1 is in the open configuration of FIG. 3. That is, the notepad 18 will be held in a stationary writing position to enable the user to take notes upon a flat surface without having to use his hands to prevent the notepad 18 from sliding about.

When the notepad 18 is not being used for taking notes, the user may lay articles (such as a file folder 22) on top of the notepad so as to be transported together in the carrying case 1 and provide the advantage of a portable office. In the alternative, the file folder 22 may have one or more pieces 24 of hook and loop fastener material to enable the file folder 22 to be attached directly to the sheet 12 of hook and loop fastener material in place of the notepad 18. Moreover, other modules can be substituted for the notepad 18. For example, a notebook computer (not shown) having hook and loop fastener material affixed thereto may also be attached to the sheet 12 of hook and loop fastener material at the side 4 of carrying case 1 opposite the side 2 along which the purse 14 is held.

Details of the purse 14 that is detachably connected to the carrying case 1 and the personal and business submodules that are detachably connected to the purse 14 are now described while referring concurrently to FIGS. 3–6 of the drawings. Like the carrying case 1, the purse 14 is preferably formed from a soft material having first and second sides 26 and 28 that are held in a closed configuration (best shown in FIG. 5) one above the other by means of a zipper 30. In accordance with another important aspect of this invention and also like the carrying case 1 within which it is carried, each side 26 and 28 of the purse 14 is covered with a sheet 32 and 34 of hook and loop fastener material.

The purse 14 is now adapted to hold a plurality of personal and/or business submodules 36–42 in a predetermined order to meet the needs of the user. By way of example only, the personal and business submodules that may be carried within the purse 14 include a set of car keys 36, a photograph/credit card holder 37, a case 38 for eyeglasses, a business card holder 39, a remote control garage door/gate opener 40, an electronic calendar/planner 41, and a palm computer 42 to name but a few. Of course, it is to be recognized that the submodules 36–42 listed above are merely examples and different submodules may be organized within the purse 14 according to the particular needs of the user. What is more, and depending upon the size of the purse 14, not all of the submodules 36–42 may be carried in the purse at the same time.

As an additional advantage of this invention, some of the submodules (e.g. 38) may have a window 56 or transparent surface formed therein. In this manner, the user will be able to visibly inspect the interior of the submodule to determine the contents (e.g. glasses) thereof.

Figure 6:
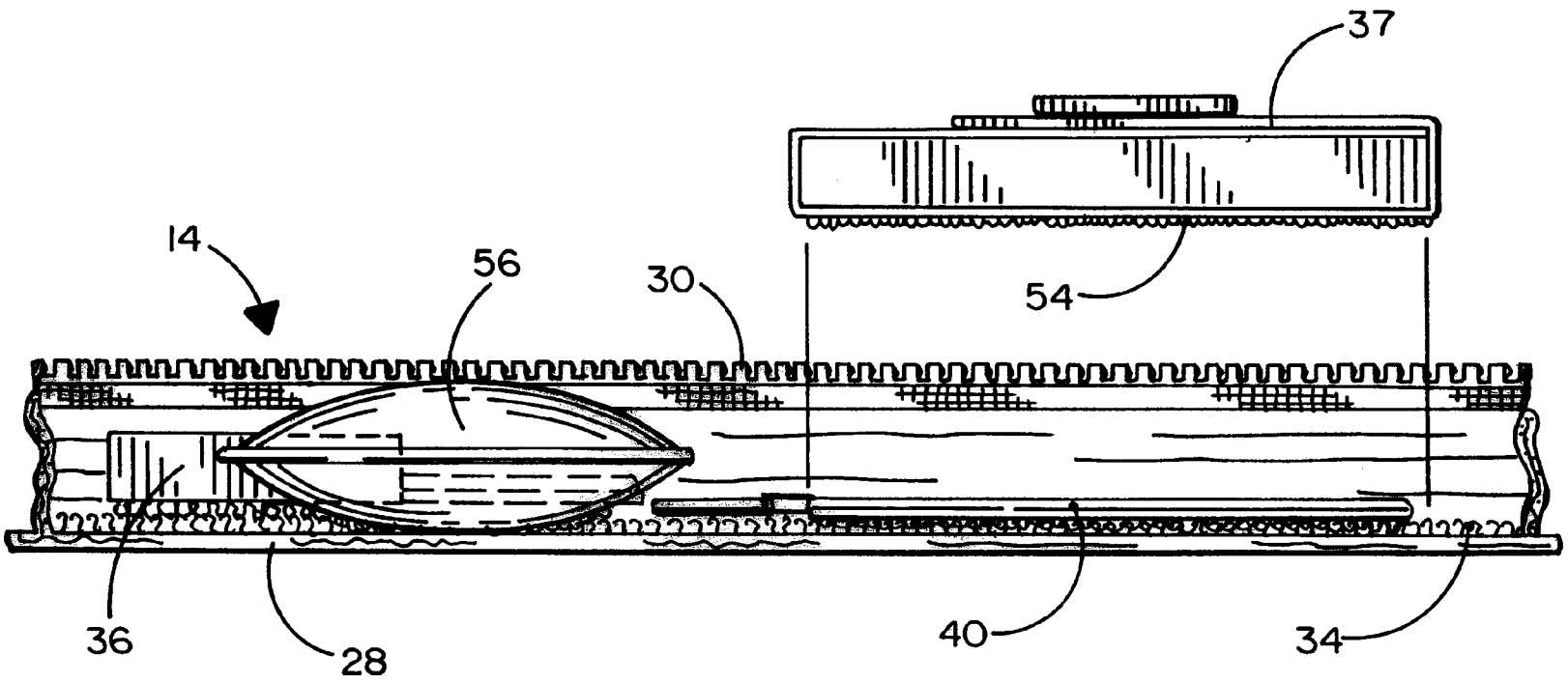
FIG. 6 shows a personal or business submodule having hook and loop fastener material by which to be removably connected to a side of the purse.

As is best shown in FIG. 6 of the drawings, one or more pieces 54 of hook and loop fastener material are affixed to each of the personal and business submodules (e.g. 37). By virtue of the foregoing, the user can neatly and selectively arrange any number of the submodules 36–42 along the sheets 32 and 34 of hook and loop fastener material at opposite sides 26 and 28 of the purse 14. Thus, all of the submodules 36–42 will be readily accessible and visible to the user without first having to conduct a search or remove all of the submodules from the purse 14. In addition, the user may easily substitute one submodule for another by simply breaking the bond between the hook and loop fastener material of the submodules 36–42 and the sheets 32 and 34 of hook and loop fastener material of the purse 14.

As illustrated in FIG. 3, the purse 14 (which itself is a module that is detachably connected to the carrying case 1) is carried in the open configuration with the opposite sides 26 and 28 thereof mated to the sheet 10 of hook and loop fastener material. However, there may be non-business situations when the user does not need the carrying case 1 or the business modules (e.g. notepad 18) therewithin. In this case, the user may detach the purse 14 from the carrying case 1 by breaking the bond between the hook and loop fastener material 16 of the purse 14 and the hook and loop fastener material 10 of the carrying case 1.

Figure 5:
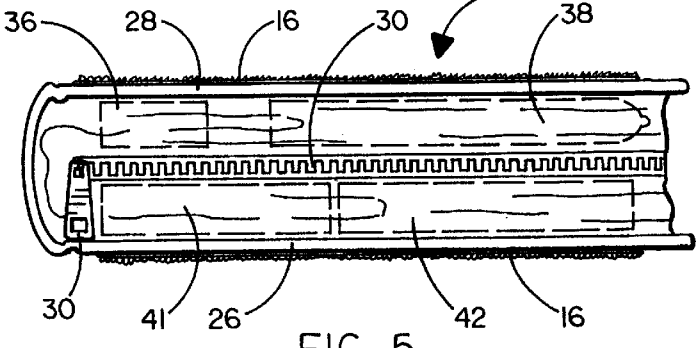
FIG. 5 shows the purse of FIG. 4 in the closed configuration.
Figure 4:
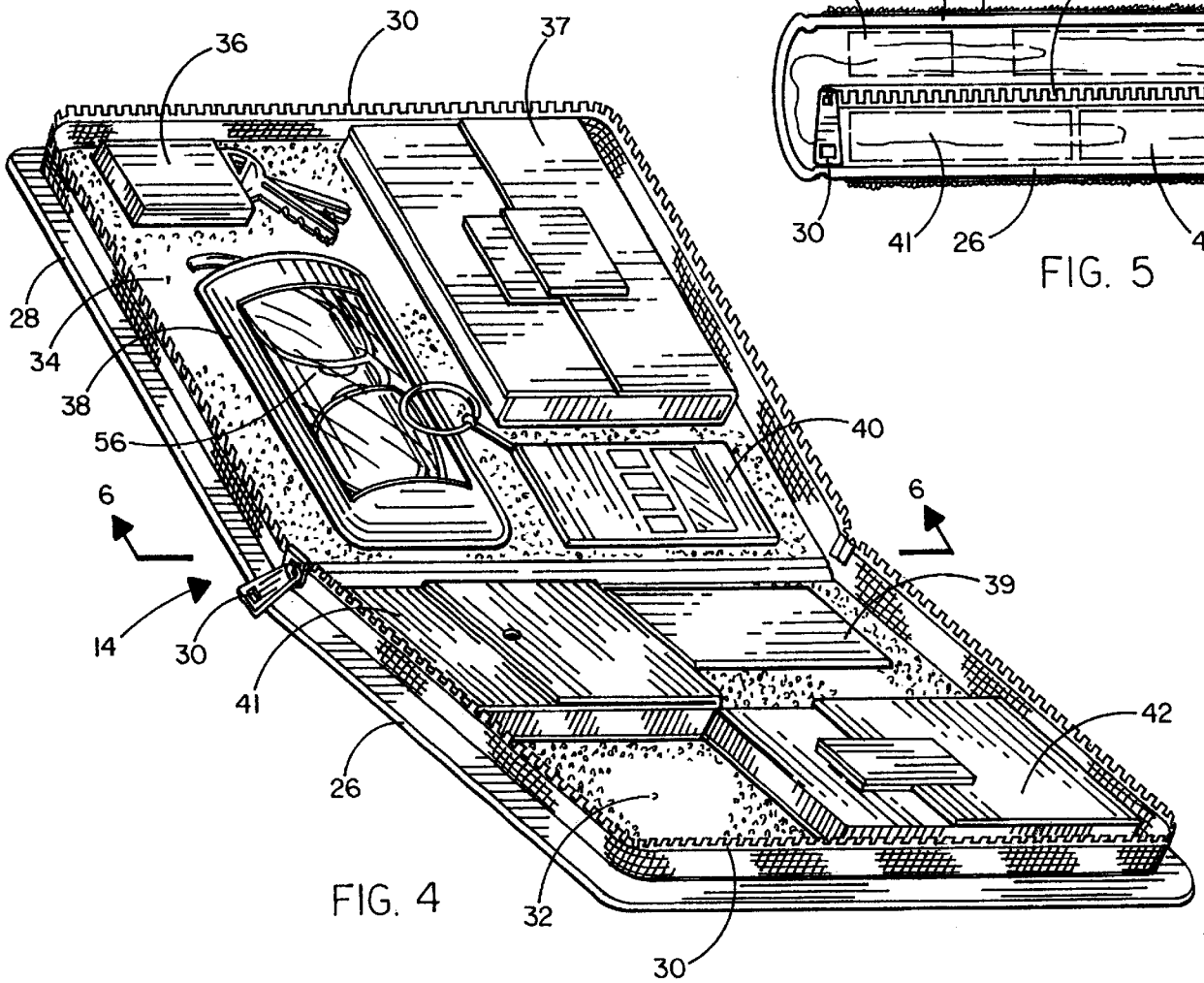
FIG. 4 shows the purse of FIG. 3 in the open configuration with a plurality of personal and business submodules removably connected at opposite sides thereof.

At this point, the purse 14 can be removed from the carrying case 1 and transported by the user in the closed configuration of FIG. 5 with the personal and business submodules neatly organized in the purse and the carrying case left behind. Thus, when the purse 14 is opened, the user will be able to quickly and easily locate and remove any of the personal and business submodules 36–42 that are carried therein. The purse 14 can later be returned to the carrying case by simply reestablishing the bond between the respective sheets 10 and 16 of hook and loop fastener material of the carrying case 1 and the purse 14.

I claim:

1. In combination:

a carrying case having first and second sides and at least a first sheet of hook and loop fastener material on said first side; and a purse in which to carry personal and business modules, said purse having first and second sides that are rotatable between open and closed configurations, an interior within which the personal and business modules are to be located, an exterior, and hook and loop fastener material located on said exterior and covering at least some of the first and second sides of said purse by which said purse is detachably connected to the first sheet of hook and loop fastener material at the first side of said carrying case, such that said purse is transported within said carrying case in the open configuration to permit access to the interior of said purse and the personal and business modules that are located therewithin.

2. The combination recited in claim 1, including a first piece of hook and loop fastener material at the interior of said purse extending along said first side thereof, a second piece of hook and loop fastener material at the interior of said purse extending along said second side thereof, and a plurality of personal and business modules having application in the personal and business life of a user, said plurality of personal and business modules having hook and loop fastener material by which said personal and business modules are detachably connected to said first and second pieces of hook and loop fastener material at the interior of said purse extending along the first and second sides thereof.

3. The combination recited in claim 2, wherein said plurality of personal and business modules include a key holder.

4. The combination recited in claim 2, wherein said plurality of personal and business modules include an eye glass holder.

5. The combination recited in claim 2, wherein said plurality of personal and business modules includes a business card holder.

6. The combination recited in claim 2, wherein said plurality of personal and business modules includes an electronic calculator.

7. The combination recited in claim 2, wherein at least some of said personal and business modules have a window formed therein through which the contents of said personal and business modules may be visually inspected.

8. The combination recited in claim 1, also including a second sheet of hook and loop fastener material on the second side of said carrying case and a business module having application in the business life of a user, said business module having hook and loop fastener material by which said business module is detachably connected to said second sheet of hook and loop fastener material on the second side of said carrying case.

9. The combination recited in claim 8, wherein said business module is a writing pad.

10. The combination recited in claim 8, wherein said business module is a file folder.

11. The combination recited in claim 1, said carrying case also having a retractable handle located at each of the first and second sides thereof, said retractable handles being slidably received within respective channels extending within each of said first and second sides.

12. In combination:

a carrying case having an interior, first and second sides at said interior, and a piece of hook and loop fastener material on at least the first of said first and second sides;

a plurality of personal and business modules for use in the personal and business life of a user, each of said plurality of personal and business modules having a piece of hook and loop fastener material thereon; and a purse in which to transport said plurality of personal and business modules, said purse having an interior and an exterior, a piece of hook and loop fastener material at said interior by which said plurality of personal and business modules are detachably connected to said purse, and a piece of hook and loop fastener material at said exterior by which said pulse is detachably connected to the first side of said carrying case to be carried at the interior thereof.

* * * * *